US005213481A

United States Patent [19]

Stringfellow et al.

[11] Patent Number: 5,213,481

[45] Date of Patent: May 25, 1993

[54] FUEL PUMPING APPARATUS

[75] Inventors: Christopher Stringfellow; Peter A. G. Collingborn, both of Kent; Derek W. Tomsett, Rye, all of England

[73] Assignee: Lucas Industries public limited company, West Midlans, England

[21] Appl. No.: 832,817

[22] Filed: Feb. 7, 1992

[30] Foreign Application Priority Data

Feb. 16, 1991 [GB] United Kingdom ..... 9103318
Jun. 28, 1991 [GB] United Kingdom ..... 9114050
Aug. 24, 1991 [GB] United Kingdom ..... 9118318

[51] Int. Cl.[5] ..... F04B 19/02

[52] U.S. Cl. ..... 417/252; 417/462; 123/450

[58] Field of Search ..... 417/462, 252, 289, 307; 123/450

[56] References Cited

U.S. PATENT DOCUMENTS 4,282,843 8/1981 Seilly et al. ..... 417/462 X
5,035,587 7/1991 Collingborn ..... 417/462
5,080,563 1/1992 Tomsett ..... 417/462
5,129,380 7/1992 Nicol ..... 417/462 X

*Primary Examiner*—Richard E. Gluck
*Attorney, Agent, or Firm*—Trexler, Bushnell, Giangiorgi & Blackstone, Ltd.

[57] ABSTRACT

A fuel pumping apparatus of the rotary distributor type has a fluid pressure operable valve which can be opened to terminate delivery of fuel to an associated engine. The operation of the valve is controlled by an axially movable shuttle contained in a cylinder. The shuttle is biased toward one end of the cylinder and is displaced away from the one end of the cylinder by fuel supplied by an auxiliary plunger. The shuttle is angularly movable by an actuating mechanism to vary the extent of movement before operation of the valve. The shuttle is biased to the one end of the cylinder by a shuttle return piston in order to reduce the frictional loads on the actuating mechanism. The cylinder containing the return piston is connected to an accumulator chamber.

12 Claims, 5 Drawing Sheets

FUEL PUMPING APPARATUS

Figure 1:
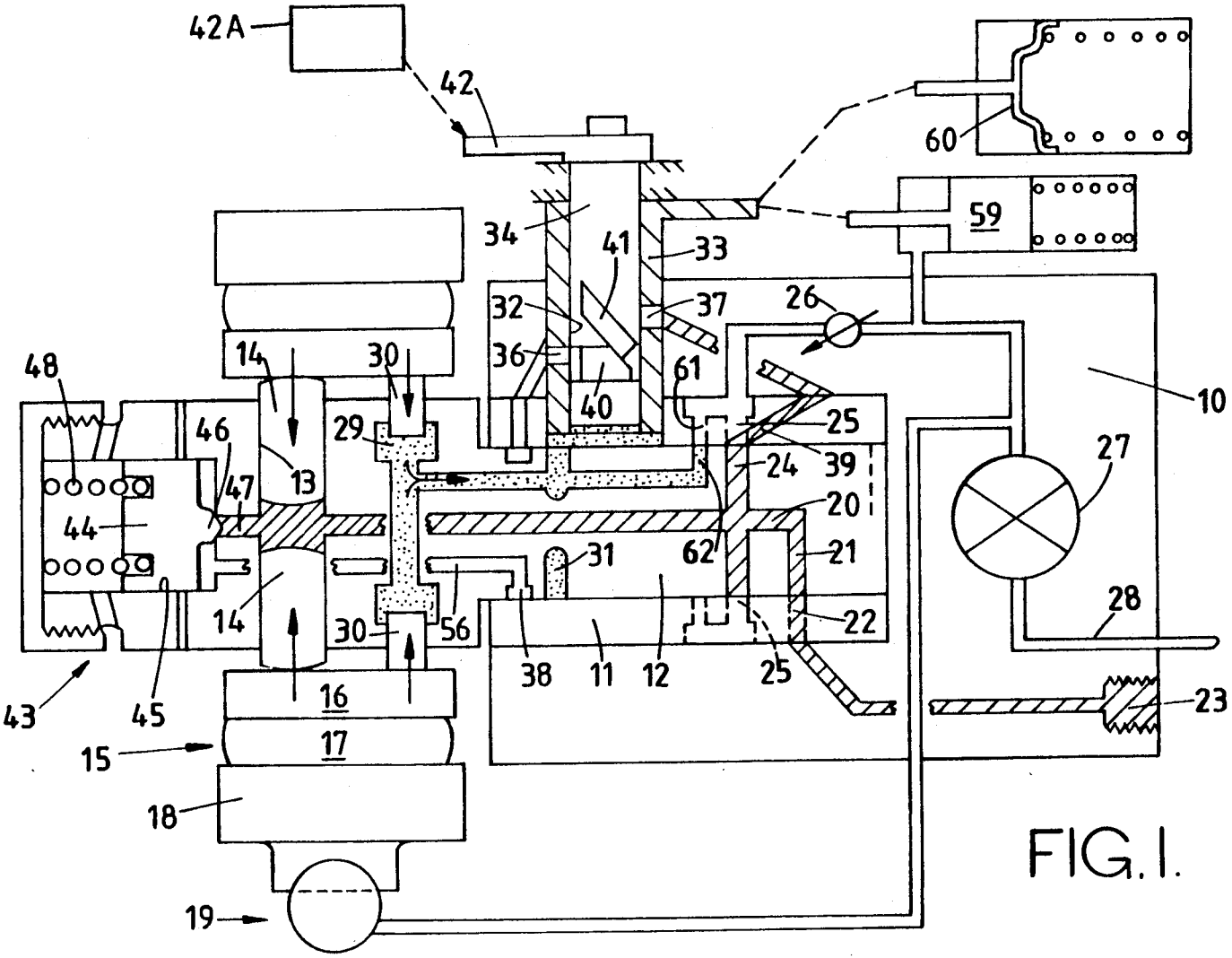

This invention relates to a fuel pumping apparatus for supplying fuel to an internal combustion engine and of the kind comprising a rotary distributor member housed in a body, the distributor member being driven in synchronism with the associated engine, a bore formed in the distributor member and a pumping plunger therein, a cam mounted in the body and having a plurality of cam lobes adapted to impart inward movements to the pumping plunger as the distributor member rotates, a passage connected with the bore and arranged to communicate in turn as the distributor member rotates with a plurality of outlet ports, the outlet ports being formed in the body and being connected in use to the injection nozzles respectively of the associated engine, means including a low pressure fuel pump for feeding fuel to the bore to effect full outward movement of the pumping plunger in the intervals between the inward movements thereof, a fluid pressure operable normally closed valve which when open, allows fuel to escape from the bore during the inward movement of the plunger therein, to terminate delivery of fuel through an outlet, a further plunger mounted in a further bore and operable in synchronism with the pumping plunger, a shuttle slidable in a cylinder, passage means connecting said further bore to one end of the cylinder, means biasing the shuttle towards said one end of the cylinder, said shuttle being moved away from said one end of the cylinder by fuel displaced during the inward movement of said further plunger, said shuttle after a predetermined movement thereof away from said one end of the cylinder causing the application of fluid under pressure to said valve to open the valve, the shuttle being movable angularly to vary the extent of said predetermined movement and an actuating mechanism coupled to the shuttle for determining the angular setting of the shuttle.

In the above form of apparatus the shuttle is returned to the one end of the cylinder as the further plunger is allowed to move outwardly. The return motion of the shuttle is conveniently effected by means of a spring. However, if the spring is engaged directly with the shuttle then some form of anti-friction bearing must be provided between the spring and the shuttle or between the spring and a spring abutment in order that angular movement of the shuttle by the actuating mechanism shall not be impaired. Alternatively the spring abutment must be made to move angularly with the shuttle an arrangement which involves some form of coupling which can itself cause friction.

A further consideration is the stress to which the spring is subjected when the apparatus is in use. Although the pressure of fuel which is supplied to the one end of the cylinder does not approach the pressure of fuel developed by the pumping plunger it nevertheless will be appreciably higher than the fuel pressure which is developed by the low pressure fuel pump. Moreover, the spring must be able to generate sufficient force so that the shuttle is held at said one end of the cylinder when said passage means is connected to the outlet of the low pressure pump in order to make up any leakage of fuel which has taken place during the preceding cycle of operation of the further plunger. Furthermore, the travel of the shuttle is considerable and the frequency of operation is high. The above considerations require a demanding spring specification.

The object of the invention is to provide an apparatus of the kind specified in a simple and convenient form.

According to the invention an apparatus of the kind specified comprises a shuttle return piston slidable within a further cylinder, the shuttle return piston engaging the end of the shuttle remote from said one end of the shuttle cylinder, the diameter of said shuttle return piston being slightly greater than that of the shuttle, an accumulator chamber connected to the end of the further cylinder remote from the shuttle, a restriction for restricting the rate at which fluid can pass between the further cylinder and the accumulator chamber and said accumulator chamber being in part defined by a spring loaded piston having an area which is greater than the area of the shuttle return piston.

Figure 2:
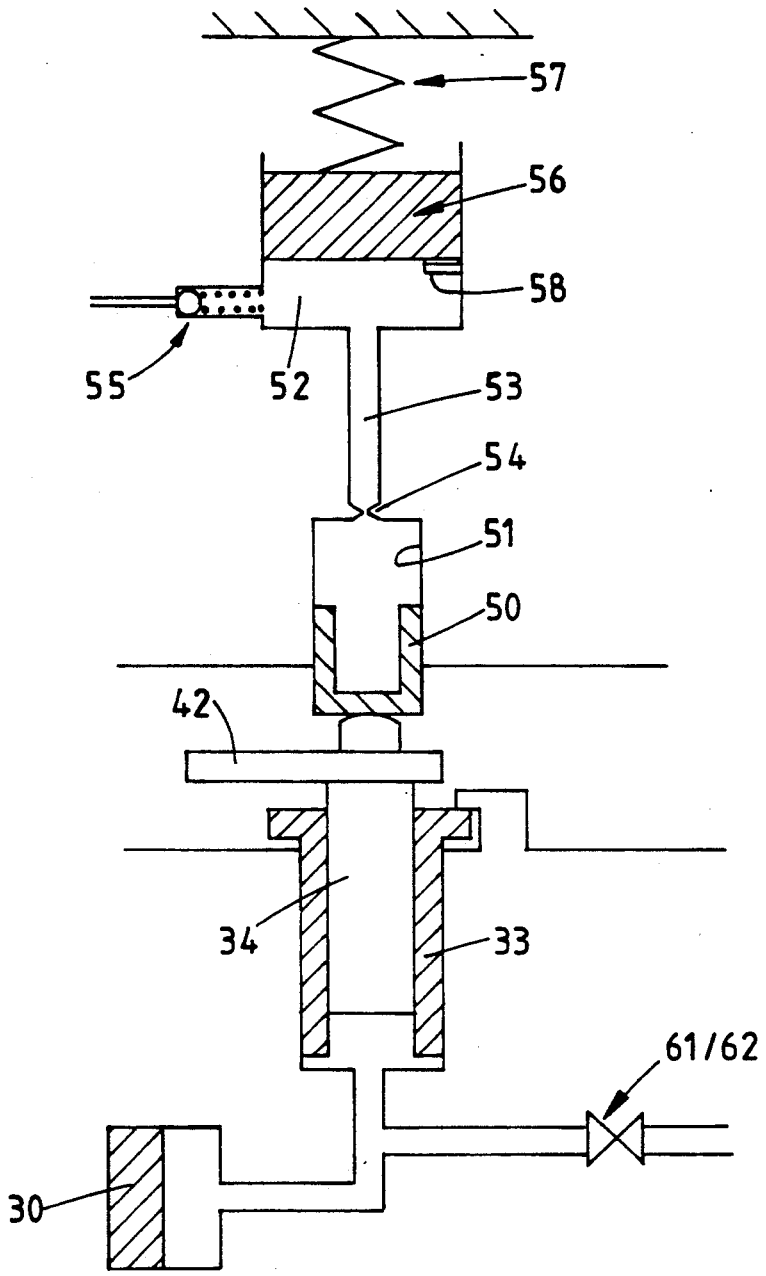
Figure 3:
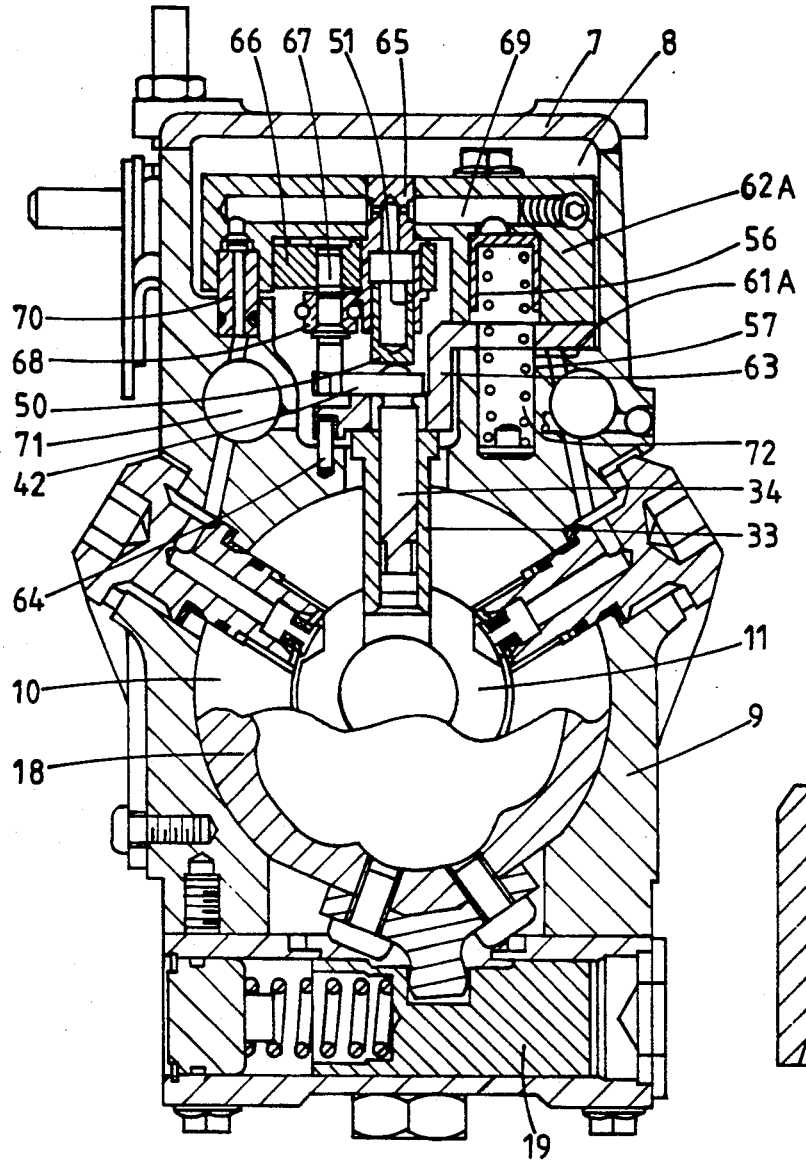
Figure 4:
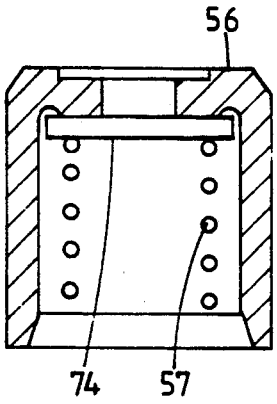
Figure 5:
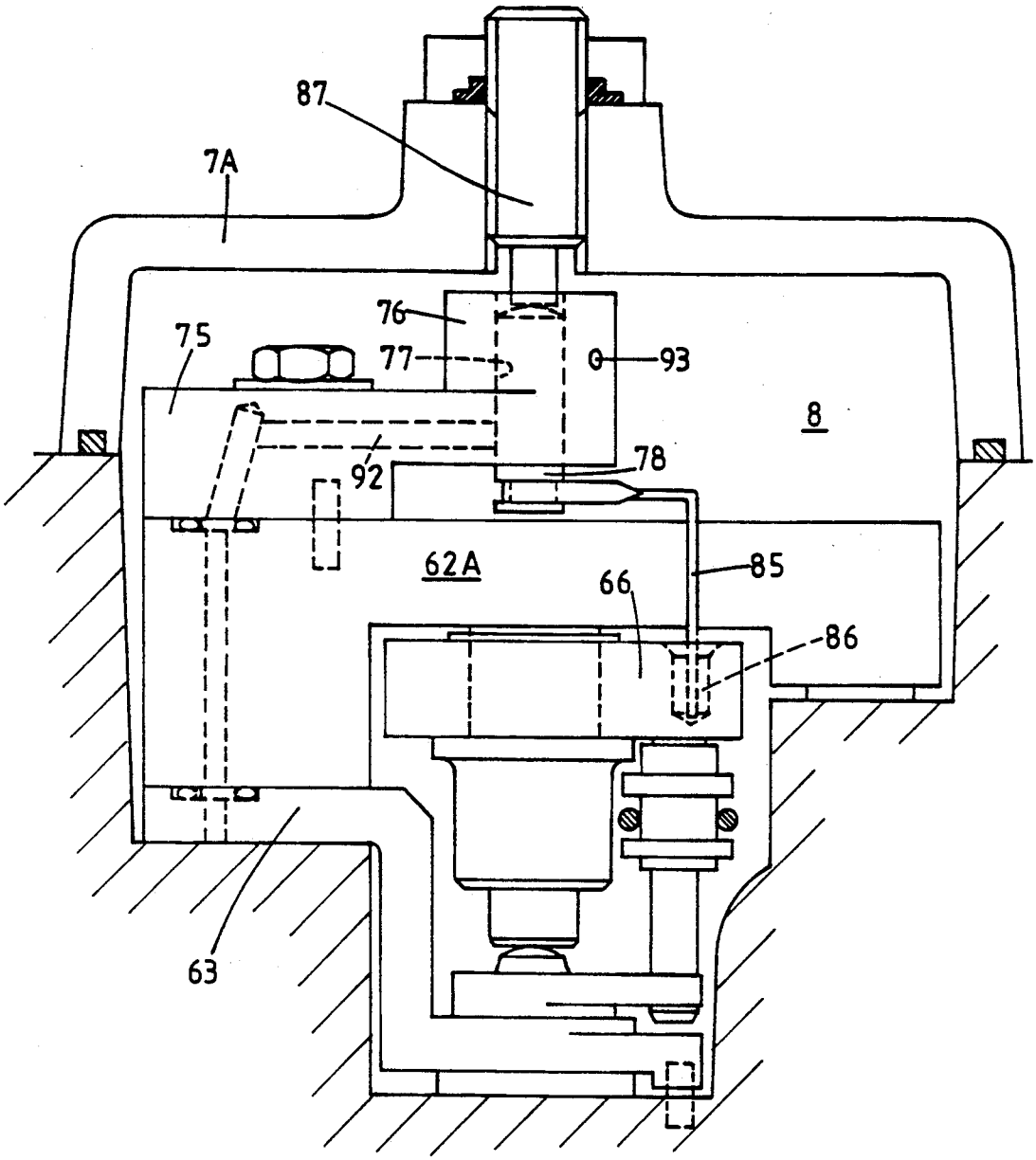
Figure 6:
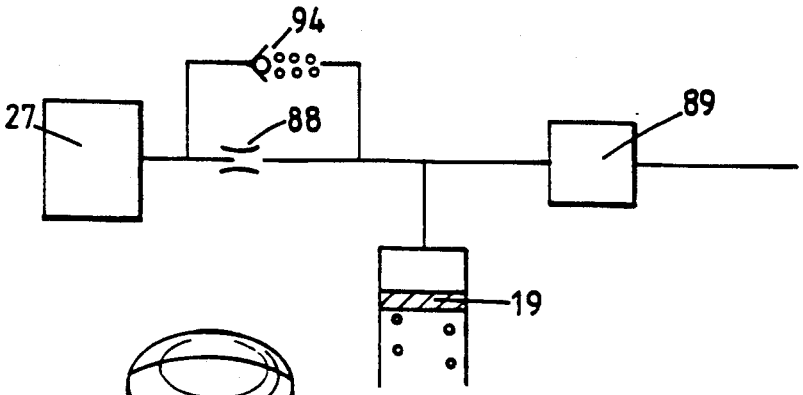
Figure 7:
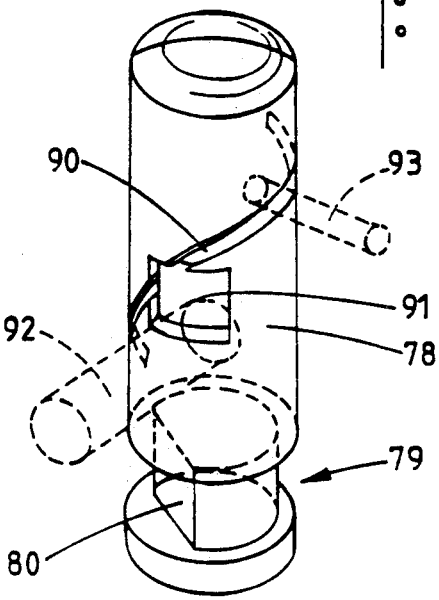
Figure 8:
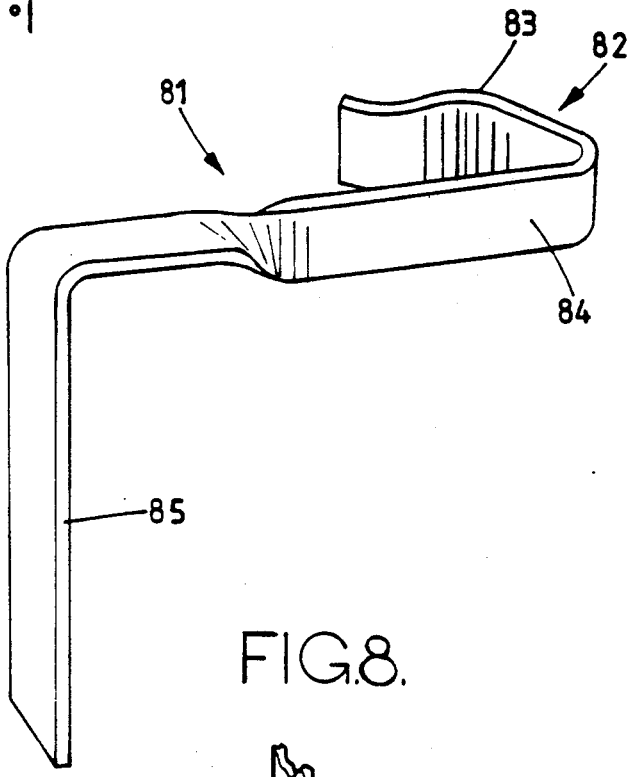

In the accompanying drawings:

FIG. 1 is a diagrammatic part sectional view of the apparatus,

FIG. 2 is a view to an enlarged scale of a further part of the apparatus seen in FIG. 1, FIG. 3 is a sectional end view of a practical form of the apparatus, FIG. 4 shows a detail of part of the apparatus seen in FIG. 3, FIG. 5 is a view in the opposite direction to that of FIG. 3 showing the additional components for providing a load signal, FIG. 6 is a diagram of the added hydraulic circuit, FIG. 7 is a perspective view of one of the additional components, and FIG. 8 is a perspective view showing another of the additional components.

Figure 9:
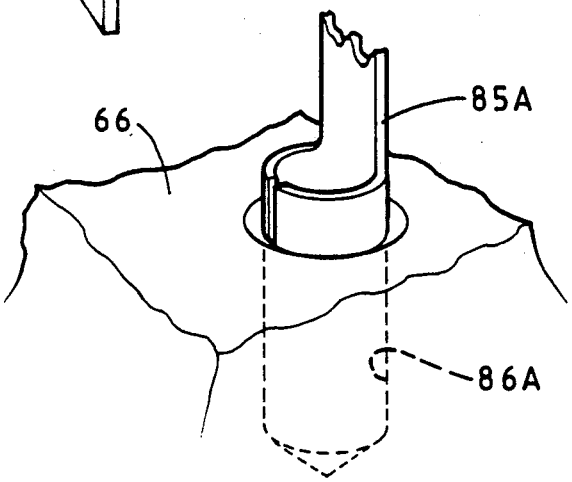

FIG. 9 shows a perspective view of a modification to the component shown in FIG. 8.

Referring to the drawings, the apparatus comprises a body 10 in which is mounted a fixed sleeve 11 defining a bore to receive a rotary cylindrical distributor member 12. The distributor member has an enlarged diameter portion projecting from the bore and in use is driven in timed relationship with an associated engine.

Formed in the enlarged portion of the distributor member is a transverse bore 13 in which is mounted a pair of pumping plungers 14 the outer ends of which engage cam followers 15 each cam follower comprising a shoe 16 and a roller 17. The rollers engage the internal peripheral surface of an annular cam ring 18 which is mounted within the body 10. The angular position of the cam ring is adjustable by means of a fluid pressure operable spring biased piston 19, in known manner.

On the internal peripheral surface of the cam ring there is formed a plurality of pairs of cam lobes which extend from the base circle of the cam ring. As the distributor member rotates, the rollers engage with the leading flanks of the cam lobes to impart inward movement to the pumping plungers 14. The bore 13 is in communication with a longitudinal passage 20 which at one point communicates with a radially disposed delivery passage 21 positioned to register in turn with a plurality of outlet ports 22 formed in the sleeve and extending to outlets 23 respectively which are connected in use to the injection nozzles of the associated engine.

At another position the passage 20 is in communication with a plurality of radially disposed inlet passages 24 which are positioned to register in turn with inlet ports 25 formed in the sleeve 11 and communicating by way of an on/off valve 26, with the outlet of a low pressure fuel supply pump 27 having a fuel inlet 28.

Although not shown, the inlet and outlet of the supply pump 27 are interconnected by way of a relief valve and the rotary part of the pump is coupled to the distributor member. By reason of the relief valve, the output pressure of the low pressure pump 27 varies in accordance with the speed at which the distributor member is driven and the aforesaid piston 19 is subjected to the outlet pressure of the low pressure pump so that the angular setting of the cam ring depends upon the speed of the associated engine.

The passage 21 is arranged to register with an outlet port 22 during the whole time the plungers 14 are moved inwardly so that fuel displaced from the bore 13 can flow to the associated engine. As the distributor member rotates and as the rollers move over the crests of the cam lobes, the passage 21 moves out of register with an outlet port 22 and an inlet passage 24 moves into register with an inlet port 25. Fuel is therefore supplied to the bore 13 from the outlet of the low pressure pump and the plunger 14 are moved outwardly to their maximum extent so that the rollers engage the base circle of the cam ring. As described there is no method of controlling the quantity of fuel supplied through an outlet 23. In order to achieve the desired control, there is provided a further transverse bore 29 in the enlarged portion of the distributor member and located in the bore is a pair of further or auxiliary plungers 30 the outer ends of which engage the shoes 16 so that the auxiliary plungers are moved inwardly at the same time as the pumping plungers. The bore 29 is in constant communication with a circumferential groove 31 formed in the periphery of the distributor member and this groove is in constant communication with one end of a shuttle cylinder 32 which for convenience is defined by the bore of a sleeve 33 which is angularly adjustable within the body part 10 but is restrained from axial movement. Slidable within the shuttle cylinder 32 is a shuttle 34 which is biased as will be described, towards the one end of the cylinder.

Formed in the sleeve 33 is a pair of axially spaced ports 36 and 37. The port 36 is in constant communication with a circumferential groove 38 formed on the distributor member whilst the port 37 is in constant communication with a port 39 which is formed in the sleeve and which opens onto the periphery of the distributor member at a position to register with the inlet passages 24. The registration of the port 39 with an inlet passage 24 is arranged to occur during the time the pumping plungers 14 are moved inwardly. The shuttle 34 is provided with a groove 40 which is in constant communication with the port 36 and extending from the groove 40 is an inclined groove 41 which as will be explained, is positioned to register with the port 37 after a predetermined movement of the shuttle. The shuttle is angularly adjustable and for this purpose is provided with an arm 42 which-is coupled to an actuating mechanism in the form of a governor 42A. By moving the shuttle 34 angularly the extent of movement of the shuttle away from said one end of the cylinder before the port 37 is brought into register with the groove 41, can be adjusted.

Also provided is a normally closed valve generally indicated at 43 and including a piston 44 which is housed within a cylinder 45 defined in an extension of the distributor member 12. The piston 44 is integral with a valve member 46 which co-operates with a seating defined in the end wall of the cylinder 45, the seating being located at one end of a passage 47 which communicates with the bore 13. The piston 44 is biased by a spring 48 so that the valve member 46 engages with the seating 48 and the spring is sufficiently strong to ensure that the valve member 46 is held in sealing engagement with the seating.

Operation starts with the items in the positions shown in FIG. 1 which corresponds to the commencement of inward movement of the pumping plungers 14 and the auxiliary plungers 30. As the distributor member rotates the plungers 14 will displace fuel from the bore 13 and delivery of fuel to the associated engine will take place through an outlet 23. At the same time the plungers 30 are moved inwardly and fuel is displaced into the inner end of the cylinder 32 containing the shuttle 34. The shuttle therefore starts to move against the action of the means biasing the shuttle and this movement will continue so long as the plungers are moved inwardly. At some point during the movement of the shuttle the port 37 is brought into register with the groove 41 and fuel at the high pressure developed by the plungers 14 is supplied to the inner end of the cylinder 45 and this fuel acts upon the piston 44 to urge the piston against the action of the spring 48. As soon as the piston 44 starts to move, the valve member is lifted from its seating and the remaining fuel which is displaced by the plungers 14 can flow into the cylinder 45 through the passage 47 thereby displacing the piston 44 against the action of the spring 48. By varying the angular position of the shuttle 34 the extent of movement of the shuttle before the port 37 registers with the groove 41 can be controlled and therefore the position during the inward movement of the plungers 14 at which the valve 43 is opened. Thus by moving the shuttle angularly the quantity of fuel which can be supplied to the associated engine can be varied. As stated, the arm 42 is connected to the governor 42A which will be either of the so-called all-speed type or the so-called two-speed type. The sleeve 33 can also be moved angularly and two ways of achieving this are illustrated. In the first case a fluid pressure operable piston 59 is provided, the piston being spring biased against the action of the outlet pressure of the low pressure pump. By connecting the piston to the sleeve 33, so called torque control can be obtained. Another way of moving the sleeve is by means of an air pressure responsive diaphragm 60 which is responsive to the pressure of air delivered to the associated engine, the piston 59 and the diaphragm 60 can if desired, both be provided to control the position of the sleeve.

When the plungers complete their inward movement and the rollers 17 move over the crests of the cam lobes, the plungers can move outwardly and fuel is returned from the one end of the cylinder 45 to the bore 13 by movement of the piston 44 by the spring 48. However, since fuel may have been supplied to the associated engine, fuel is supplied through one of the inlet passages 24 to the bore 13 to ensure that the plungers move outwardly their maximum extent. The shuttle 34 will also be urged towards the inner end of the cylinder 32 displacing fuel back to the bore 29. Any additional fuel which is required to make up for leakage, is supplied by means of auxiliary filling ports 61 connected to the outlet of the fuel supply pump and communicating at the appropriate time, with a passage 62 in the distributor member and which is in communication with the bore 29. The plungers 30 are moved outwardly to their maximum extent.

Turning now to FIG. 2 the outer end of the shuttle 34 is engaged by a shuttle return piston 50 which is slidable in a further cylinder 51. Also provided is an accumulator chamber 52 which is in communication with the cylinder 51 by way of a passage 53 incorporating a restrictor 54. The accumulator chamber is in communication with the outlet of the low pressure pump 27 by way of a one way valve 55 and the accumulator chamber is in part defined by an accumulator piston 56 which is spring biased by means of a spring 57 towards a stop 58. The area of the accumulator piston 56 is greater than that of the shuttle return piston 50 which in turn is larger than that of the shuttle 34. Moreover, the spring 57 is of sufficient strength so as to be able to hold the accumulator piston 56 against the stop 58 against the force developed on the piston by the output pressure of the low pressure pump 27. The area of contact between the shuttle 34 and the return piston 50 is minimised by making the presented surface of one of the components, in this case the shuttle, of convex form.

In operation, when the auxiliary plungers 30 are moved inwardly the shuttle 34 will as described, be moved upwardly as shown in FIG. 2, causing movement of the shuttle return piston 50 which in turn displaces fuel by way of a restrictor 54 into the accumulator chamber 52. The accumulator piston moves to accommodate the fuel, away from the stop 58 by a lesser amount because of its larger area. When the auxiliary plungers 30 are allowed to move outwardly the fuel stored in the accumulator chamber is returned to the cylinder 51 and the piston 50 together with the shuttle 34 are returned to the positions shown. When during the return motion the accumulator piston engages the stop 58 the non-return valve 55 opens to allow fuel flow into the accumulator chamber 52 to make up for any fuel which has leaked along the working clearances between the pistons 50 and 56 and the respective cylinders. Moreover, even when the passage 62 is brought into register with a port 61 and fuel at the outlet pressure of the low pressure pump is applied to the underside of the shuttle, there will still be a net force acting to urge the shuttle 34 and the shuttle return piston 50 downwardly in view of the larger diameter of the return piston 50, and since the space between the shuttle 34 and the return piston 50 is at a low pressure. The purpose of the restrictor 54 is to damp the movement of the shuttle 34 and the shuttle return piston 50, in particular to ensure that the shuttle 34 does not separate from the fuel column between the shuttle and the auxiliary plungers 30 and to ensure that the auxiliary plungers 30 remain under the control of the cam lobes.

By the arrangement described the forces which restrain angular movement of the shuttle 34 are kept to a minimum. Furthermore the spring 57 although stronger than that which would be required to bias the shuttle 34 if it were applied directly to the shuttle, has to accommodate a reduced movement and is easier to design.

With reference now to FIG. 3 of the drawings, the body 10 is located within a housing or casing 9 which defines a chamber 8 which is closed by a cover 7. The chamber contains fuel at low pressure. The shuttle 34 and sleeve 33 extend into the chamber and within the chamber there is formed a locating surface 61A. Accommodated within the chamber is a support body 62A which is secured by screws to the portion of the casing which defines the locating surface 61A and a stop bracket 63 of double "L" shaped form has one of its limbs interposed between the locating surface and the support body. The other limb of the stop bracket is apertured to allow the shuttle 34 to pass therethrough and the stop bracket is accurately located by means of a dowel pin 64. This limb of the stop bracket on one face serves to locate the sleeve 33 and its other face serves as a stop face which is engageable by the arm 42 to limit the movement of the shuttle 34 into the sleeve 33.

The support body 62A carries a flanged shaft 65 which is a press fit in the support body and angularly movable about the shaft and located between the flange thereof and the support body is a lever 66 in which is mounted a depending pin 67. Mounted about the pin is a roller 68 having a groove in which is located a governor link which forms what can be regarded as the output member of the governor mechanism 42A. The pin 67 is also engaged with the arm 42 in such a manner that the arm can move axially relative to the pin as the shuttle 34 moves axially but movement of the pin with the lever 66 will impart angular movement to the shuttle.

The flanged shaft 65 defines the cylinder 51 for the shuttle return piston 50 and the inner end of the cylinder by means of a cross drilling in the shaft which forms the restrictor 54, communicates with a passage 69 in the support body 62A. This passage is plugged at one end and is blind at its other end which by way of a sleeve 70 communicates with a fuel supply gallery 71 which in turn communicates with the outlet of the pump 27. A plate valve element is located between the end of the sleeve 70 and the passage-69 to form the valve 55.

The plugged end of the passage 69 communicates with the inner end of the accumulator chamber 52 which contains the accumulator piston 56. The spring 57 which biases the accumulator piston passes through an opening in the stop bracket 63 and into a recess 72 in the casing 9. The spring is provided with a hardened abutment which engages the base of the recess. The end wall of the chamber 52 serves as the stop 58 which limits the movement of the accumulator piston under the action of its spring and its movement in the opposite direction is limited by its engagement with the stop bracket 63. Moreover, the recess 72 communicates with the chamber 8 by way of a slot (not shown) to vent the underside of the piston. The apparatus functions as described previously.

FIG. 4 shows a safety feature in the form of a plate valve 74 which is interposed between the accumulator piston 56 and its spring 57 and which in the event that the piston 56 sticks can open to prevent the development of excessive pressure as the plungers 30 move inwardly.

The timing of fuel delivery in the apparatus as described varies in accordance with the speed at which the associated engine is driven. In some cases it is desirable that the position of the cam ring should vary also in accordance with the amount of fuel which is being supplied to the engine. This is achieved by providing a further attachment to the apparatus.

With reference to FIG. 5 of the drawings, there is mounted on the upper surface of the support body 62A a support arm 75 for a valve housing 76. Formed in the valve housing is an axial bore 77 and slidable axially and movable angularly within the bore is a cylindrical valve member 78 which is seen in perspective in FIG. 7. The upper end of the valve member is domed and adjacent the lower end is a groove 79. A flat 80 is defined on a portion of the valve member which defines the base wall of the groove. Located in the groove is one end portion 82 of a spring actuating arm 81 which is seen in perspective in FIG. 8. The arm is formed from strip material such as spring steel and the aforesaid end portion 82 is hooked so as to form a clip whereby it is retained in the groove. Moreover the end portion includes a flat portion 84 which locates against the flat 80 of the valve member whereby the valve member can be moved angularly by the arm. The arm 81 extends outwardly from the valve member and the strip is twisted through 90° and then is bent at right angles to define a depending limb 85. The limb 85 is located in a recess 86 in the lever 66 so that as the lever is moved angularly by the governor mechanism so also will be the valve member 78. In addition, the arm 81 also imparts an upward axial thrust of the valve member into engagement with an adjustable stop 87 which is mounted in a modified cover 7A.

The valve housing 76 and the valve member 78 form a pressure control calve 89 which is incorporated in an additional hydraulic circuit seen in FIG. 6. The cylinder containing the timing piston 19 instead of being connected directly to the output of the low pressure pump 27 is connected thereto through an orifice 88 and the control valve controls the flow of fuel from downstream of the orifice to a drain. The orifice and valve therefore act as a fluid potentiometer and the greater the flow of fuel to the drain the greater the pressure drop across the orifice.

As seen in FIG. 7 the valve member 78 is formed with a helical groove 70 which extends on opposite sides of a recess 91 the latter being either of square or circular shape. As shown in FIGS. 5 and 7, a first port defined by a passage 92 formed in the valve housing 76 and the support body 75, communicates with the downstream side of the orifice 88. Moreover, formed in the valve body is a second port 93 which opens onto the periphery of the valve member and communicates with the chamber 8. The port 93 is positioned so that the degree of registration of the groove 90 therewith varies as the valve member is moved angularly and at low and high fuel delivery levels the port is closed so that the pressure applied to the piston 19 is the output pressure of the pump 27. As a result and assuming constant speed as the governor mechanism moves to increase the fuel delivery the pressure applied to the piston 19 will fall as the groove 90 moves into register with the port and then will increase as the groove moves out of register. The delivery of fuel will therefore be progressively retarded and then advanced. The normal speed advance will still be obtained since the output pressure of the pump 27 varies with speed. It is possible that the pressure applied to the piston 19 may fall to an undesirable level and in order to avoid this a pressure differential valve 94 is connected in parallel with the orifice 88.

If instead of one port 93 a pair of such ports are provided and spaced by a distance corresponding to the width of the groove 90, the opposite effect to that described is achieved if the groove is arranged to be uncovered to the one and the other port at low and high fuel delivery.

The provision of the adjustable stop 87 allows the axial setting of the valve member 78 to be adjusted following assembly of the apparatus and it will be appreciated that the shapes of the port or ports and the groove can be altered to obtain further shaping of the timing curve.

The construction of the end portion 82 of the arm 81 allows the arm to continue to move with the lever 66 in the event that the valve member 78 seizes in the bore 77 thereby allowing the governor mechanism to continue to control the operation of the engine.

In a modified construction of the arm 81 as seen in FIG. 9, the lower of the limb 85A is fashioned to a hollow cylindrical form and is engaged as a spring fit in a cylindrical recess 86A in the lever 66. This provides more accurate location and improved stiffness in the direction of movement of the lever and arm.

We claim:

1. A fuel pumping apparatus for supplying fuel to an internal combustion engine comprising a rotary distributor member housed in a body and driven in use in timed relationship with the associated engine, a bore in the distributor member and a pumping plunger therein, a cam mounted in the body and defining a plurality of cam lobes which impart inward movement to the pumping plunger in turn as the distributor member rotates, a passage connected with the bore and which registers with outlet ports in turn, means including a low pressure fuel pump for feeding fuel to the bore to effect full outward movement of the pumping plunger in the intervals between the inward movements thereof, a fluid pressure operable normally closed valve which when open allows fuel to escape from the bore during inward movement of the pumping plunger to terminate delivery of fuel through an outlet, a further plunger mounted in a further bore and operable in synchronism with the pumping plunger, a shuttle slidable in a cylinder, passage means connecting said further bore to one end of the cylinder, means biasing the shuttle to said one end of the cylinder, the shuttle being moved away from said one end of the cylinder by fuel displaced by said further plunger, said shuttle after a predetermined movement away from said one end of the cylinder causing the application of fluid under pressure to said valve to open the valve, the shuttle being movable angularly to vary the extent of said predetermined movement, an actuating mechanism for determining the angular setting of the shuttle, the means biasing the shuttle comprising a shuttle return piston slidable in a further cylinder the piston engaging the end of the shuttle remote from said one end of the shuttle cylinder, the diameter of the shuttle return piston being slightly greater than that of the shuttle, an accumulator chamber connected to the end of the further cylinder remote from the shuttle, a restrictor for restricting the rate at which fluid can pass between the further cylinder and the accumulator chamber and said accumulator chamber being in part defined by a spring loaded piston having an area which is greater than the area of the shuttle return piston.

2. An apparatus according to claim 1, in which one of the shuttle return piston and the shuttle has a convex surface presented to the other.

3. An apparatus according to claim 1 or claim 2, including a non return valve through which fluid can flow into said accumulator chamber to make up any leakage.

4. An apparatus according to claim 3, including a valve means through which fluid can escape from said accumulator chamber in the event of sticking of the spring loaded piston.

5. An apparatus according to claim 4, in which said valve means comprises a plate valve which is biased by the spring associated with the spring loaded piston to cover an opening in said piston.

6. An apparatus according to claim 1, in which said accumulator chamber is formed in a part which is secured in a housing of the apparatus, said part mounting a hollow shaft which defines said further cylinder and about which is mounted a lever operatively connected to an output member of the actuating mechanism said lever mounting a pin which is engaged with an arm carried by the shuttle.

7. An apparatus according to claim 6 including a valve housing adapted to be mounted on said part, an adjustable valve member mounted in said valve housing, means coupling said valve member to said lever, so that the valve member is moved therewith, said valve member and valve housing forming a valve which controls the pressure applied to a spring loaded piston which is coupled to said cam.

8. An apparatus according to claim 7, in which said valve member is angularly adjustable in said valve housing said coupling means comprising a spring actuating arm having one end portion clipped about a portion of the valve member, the arm extending outwardly from the valve member and then being bent substantially at right angles to define a depending limb the end portion of which is located in a recess in said lever.

9. An apparatus according to claim 8, in which said arm is formed from strip material the end portion being located in a groove in the valve member, said end portion including a flat portion which locates against a flat in the base wall of said groove.

10. An apparatus according to claim 9, in which said valve member is axially movable in the valve housing and is biased axially into engagement with an adjustable stop by the resilience of said arm.

11. An apparatus according to claim 9, in which said recess is of cylindrical form and the depending limb is fashioned to hollow cylindrical form.

12. An apparatus according to claim 10, in which said valve member is provided with a helical groove, a first port formed in the valve housing and in constant communication with said helical groove, said first port communicating with the outlet of the low pressure pump by way of a fixed orifice, said first port also communicating with a cylinder containing a piston coupled to said cam and a second port in the valve housing, said second port being positioned to communicate with said helical groove depending upon the angular setting of the valve member and communicating with a drain whereby the pressure applied to the piston that is coupled to said cam depends upon the setting of the shuttle.

* * * * *